US008966786B2

(12) United States Patent
Cheng

(10) Patent No.: US 8,966,786 B2
(45) Date of Patent: Mar. 3, 2015

(54) FLIP-FLOP

(71) Applicant: UEI Long Enterprise Co., Ltd., Taichung (TW)

(72) Inventor: Chien-Kai Cheng, Taichung (TW)

(73) Assignee: UEI Long Enterprise Co., Ltd., Taichung (TW)

( * ) Notice: Subject to any disclaimer, the term of this patent is extended or adjusted under 35 U.S.C. 154(b) by 223 days.

(21) Appl. No.: 13/745,578

(22) Filed: Jan. 18, 2013

(65) Prior Publication Data

US 2014/0202030 A1 Jul. 24, 2014

(51) Int. Cl.
*A43B 3/12* (2006.01)

(52) U.S. Cl.
CPC ..... *A43B 3/122* (2013.01)
USPC ..... 36/11.5; 12/142 S

(58) Field of Classification Search
USPC ..... 36/11.5, 94; 12/142 S
See application file for complete search history.

(56) References Cited

U.S. PATENT DOCUMENTS 2,932,097 A * 4/1960 George ..... 36/11.5
2,947,095 A * 8/1960 Miyachi ..... 36/11.5
8,819,962 B2 * 9/2014 Candella ..... 36/43

* cited by examiner

*Primary Examiner* — Marie Bays
(74) *Attorney, Agent, or Firm* — Alston & Bird LLP

(57) ABSTRACT

A flip-flop includes a sole and a strap unit. The strap unit includes a thong portion, and first and second strap portions, and is made by the steps of: providing superposed first and second layers of warp threads; inserting a first weft thread through sheds formed in the first layer of warp threads so as to weave the first strap portion; inserting a second weft thread through sheds formed in the second layer of warp threads so as to weave the second strap portion; and inserting the first and second weft threads through sheds which are cooperatively formed by the superposed first and second layers of warp threads so as to weave the thong portion.

7 Claims, 6 Drawing Sheets

FLIP-FLOP

BACKGROUND OF THE INVENTION

1. Field of the Invention

This invention relates to footwear, more particularly to a flip-flop.

2. Description of the Related Art

FIG. 1 shows a conventional flip-flop including a sole 11 and a strap unit 12. The strap unit 12 includes two woven straps 121 each of which has a first end portion 1210 that is secured to a left or right side of a middle part of the sole 11, and a second end portion 1211 that is stitched to the second end portion 1211 of the other one of the woven straps 121 to form a stitched thong 122. The stitched thong 122 is secured to a front part of the sole 11 and is disposed to fit between the first and second toes of a wearer's foot.

The strap unit 12 is made by two independent processes, i.e., separately weaving the two woven straps 121, and stitching the woven straps 121 to form the stitched thong 122. Thus, the strap unit 12 of the conventional flip-flop is produced with a relatively low efficiency and at a relatively high cost.

Although the strap unit 12 can be formed by a single process using a plastic material, it may give the wearer an unpleasant tactile feeling and may have a weaker stretch strength compared with the strap unit 12 made by weaving/stitching processes.

SUMMARY OF THE INVENTION

Therefore, an object of the present invention is to provide a flip-flop that can be made in a single continuous process using a weaving method, especially a double weft needles method.

According to this invention, a flip-flop includes a sole for a wearer's foot to rest thereon, and a strap unit. The sole has upper and lower surfaces, and the upper surface includes front, middle and rear regions. The strap unit includes a thong portion which has a first thong end secured to the front region, and a second thong end opposite to the first thong end, and first and second strap portions extending rearwardly from the second thong end to terminate at and be secured to left and right sides of the middle region, respectively. The strap unit is made by the steps of:

(a) providing superposed first and second layers of warp threads;

(b) inserting a first weft thread through sheds formed in the first layer of warp threads so as to weave the first strap portion along a first lengthwise line such that one of first leading and trailing ends of the first strap portion has a first oblique boundary which is at an oblique angle to the first lengthwise line;

(c) inserting a second weft thread through sheds formed in the second layer of warp threads so as to weave the second strap portion along a second lengthwise line such that one of second leading and trailing ends of the second strap portion has a second oblique boundary which is at an oblique angle to the second lengthwise line, and which joins the first oblique boundary to cooperatively define the second thong end at which the first and second lengthwise lines meet; and (d) inserting the first and second weft threads through sheds which are cooperatively formed by the superposed first and second layers of warp threads so as to weave the thong portion along a direction from one of the first and second thong ends to the other one of the first and second thong ends.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
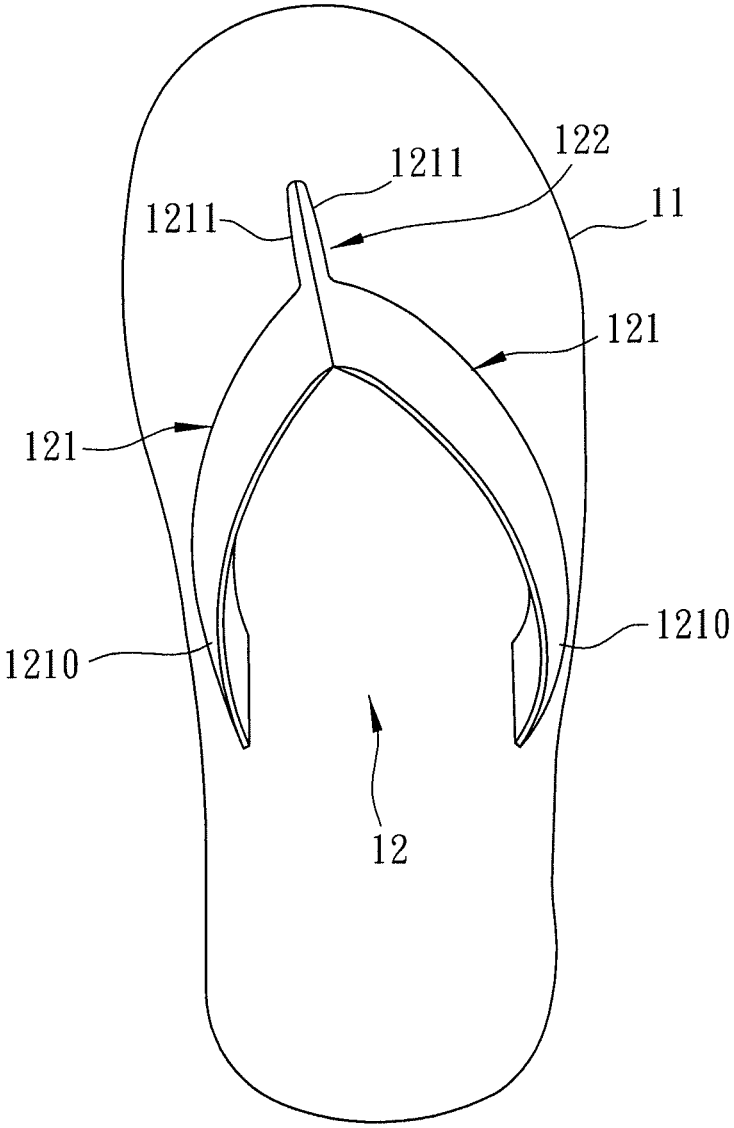
FIG. 1 PRIOR ART
FIG. 1 is a schematic view of a conventional flip-flop.

Before the present invention is described in greater detail, it should be noted herein that like elements are denoted by the same reference numerals throughout the disclosure.

Figure 2:
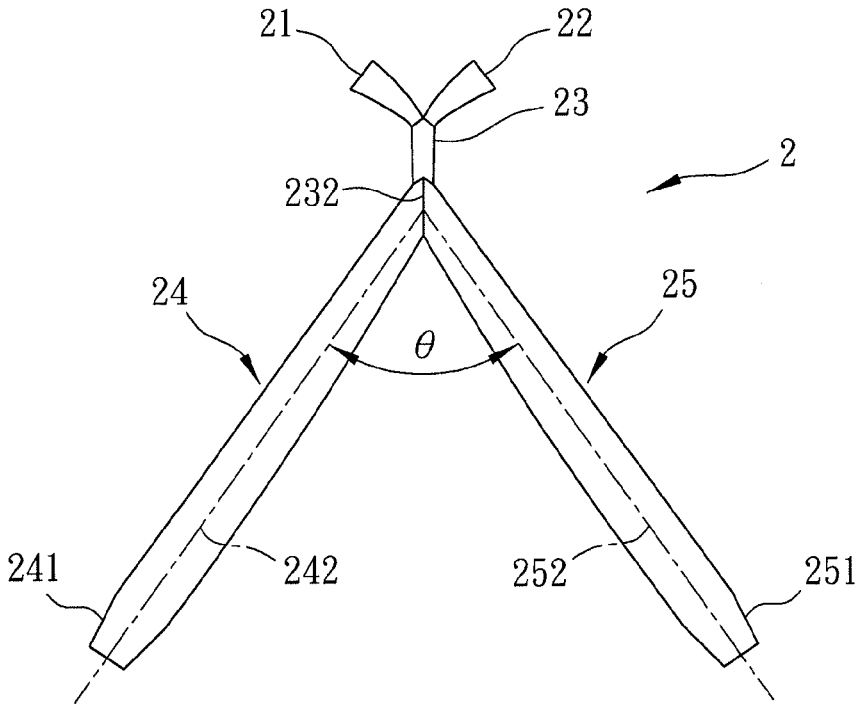
FIG. 2 is a schematic view of a strap unit used in a first preferred embodiment of a flip-flop according to this invention.
Figure 3:
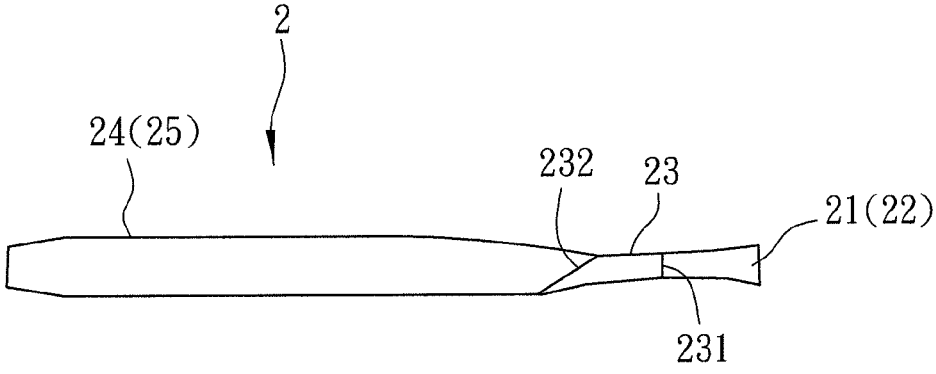
FIG. 3 is a side view of the strap unit shown in FIG. 2, showing that a first strap portion and a first extension portion are respectively stacked on a second strap portion and a second extension portion.
Figure 4:
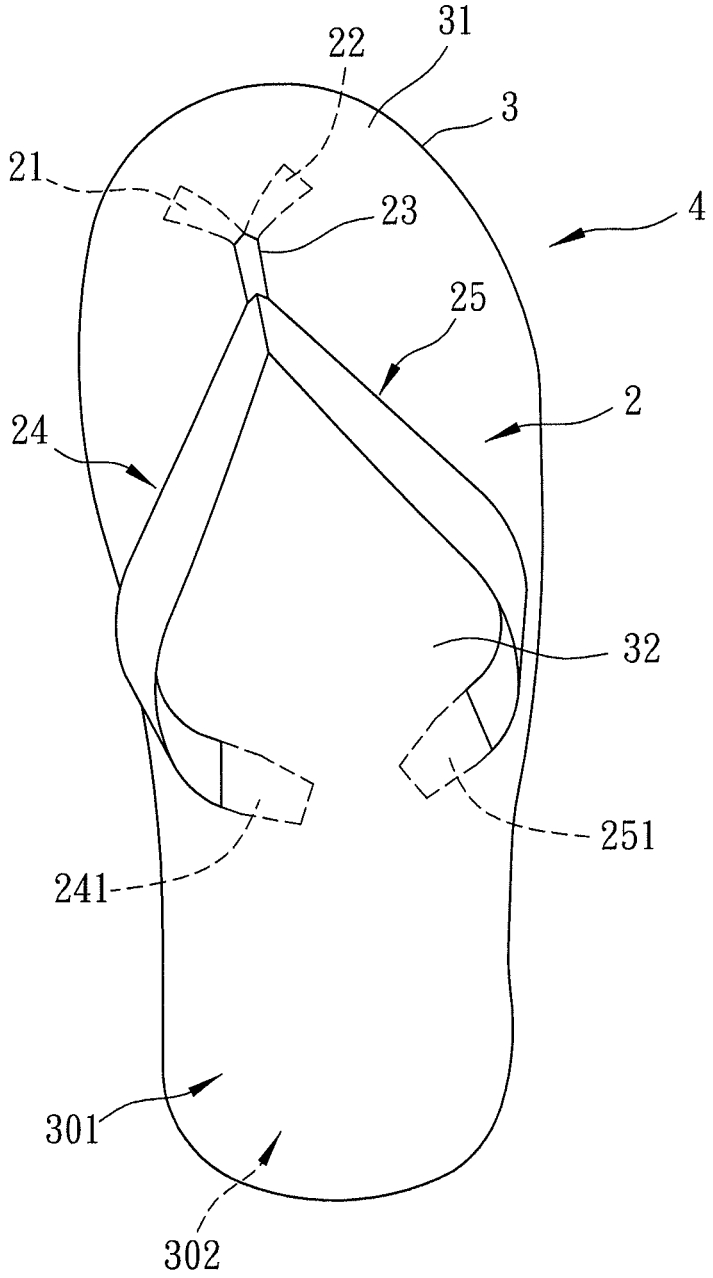
FIG. 4 is a schematic view of the first preferred embodiment of the flip-flop according to this invention.

Referring to FIGS. 2 to 4, a first preferred embodiment of a flip-flop according to this invention is shown to include a strap unit 2 and a sole 3 for a wearer's foot to rest thereon. The sole 3 has upper and lower surfaces 301, 302. The upper surface 301 includes front, middle and rear regions 31, 32, 33.

The strap unit 2 includes first and second extension portions 21, 22, a thong portion 23, and first and second strap portions 24, 25. The thong portion 23 has a first thong end 231 secured to the front region 31, and a second thong end 232 opposite to the first thong end 231 in a lengthwise direction of the strap unit 2. The first strap portion 24 extends rearwardly from the second thong end 232 through the sole 3 at a left side of the middle region 32 to terminate at a distal end 241 which is secured to the lower surface 302 of the sole 3. The second strap portion 25 extends rearwardly from the second thong end 232 through the sole 3 at a right side of the middle region 32 to terminate at a distal end 251 which is secured to the lower surface 302 of the sole 3. The first and second extension portions 21, 22 extend downwardly from the first thong end 231 through the sole 3 at the front region 31 and are secured to the lower surface 302 of the sole 3. A first lengthwise line 242 of the first strap portion 24 and a second lengthwise line 252 of the second strap portion 25 cooperatively define an included angle θ that ranges between 30° and 90°.

Figure 5:
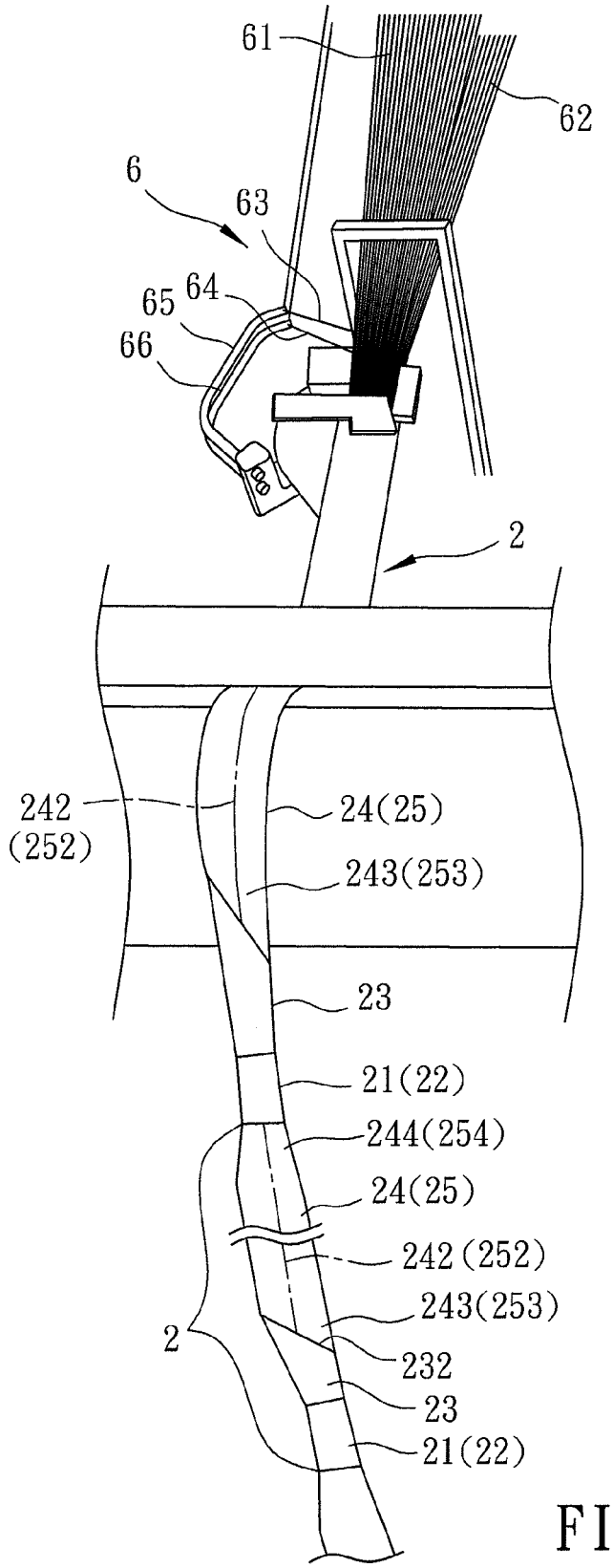
FIGS. 5 and 6 are fragmentary views illustrating the process for weaving the strap unit of this invention.
Figure 6:
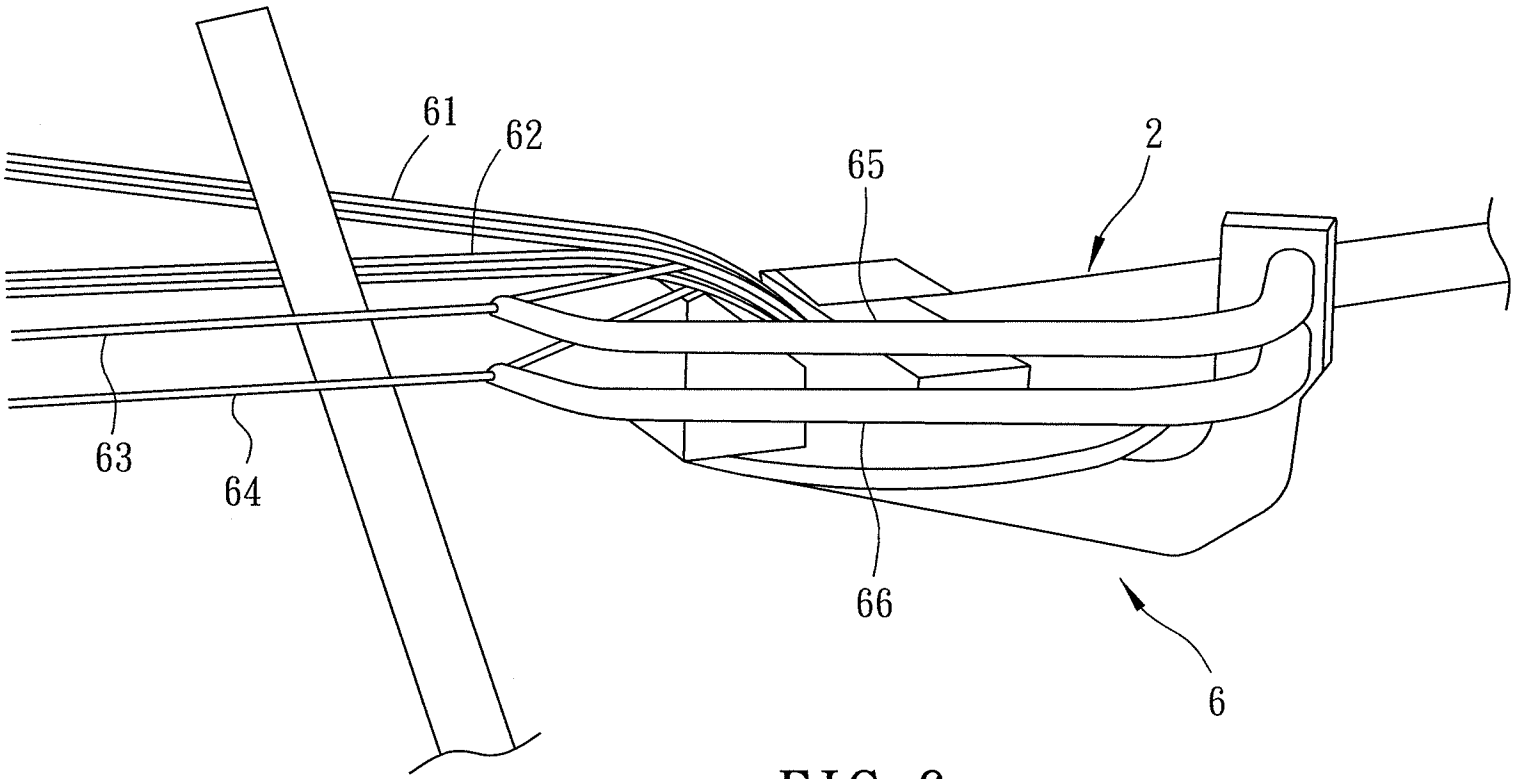

With reference to FIGS. 5 and 6, the strap unit 2 shown in FIGS. 2 and 3 is made by a double weft needles method using a needle loom 6 which is preferably a computerized jacquard loom. Steps (a) to (f) are implemented for continuously weaving a plurality of the strap units 2. It should be noted that the sequence of steps (a) to (f) is limited to that disclosed herein or shown in FIG. 5, and may vary depending on the weaving direction of the strap units 2. That is, although in the embodiment shown in FIG. 5, each strap unit 2 is woven by weaving, in order, the first and second extension portions 21, 22, the thong portion 23, and the first and second strap portions 24, 25, it may be woven in an opposite order.

In step (a), superposed first and second layers of warp threads 61, 62, which can be made by any known method, are arranged in the needle loom 6.

Instep (b), a first weft thread 63 is inserted through sheds formed in the first layer of warp threads 61 using a first weft needle 65 so as to weave the first strap portion 24 along the first lengthwise line 242 from a first leading end 243 to a first trailing end 244 such that one of the first leading and trailing ends 243, 244 has a first oblique boundary 245 which is at an oblique angle to the first lengthwise line 242. In this embodiment, the first leading end 243 has the first oblique boundary 245.

In step (c), a second weft thread 64 is inserted through sheds formed in the second layer of warp threads 62 using a second weft needle 66 so as to weave the second strap portion 25 along the second lengthwise line 252 from a second leading end 253 to a second trailing end 254 such that one of the second leading and trailing ends 253, 254 has a second oblique boundary 255 which is at an oblique angle to the second lengthwise line 252, and which joins the first oblique boundary 245 to cooperatively define the second thong end 232 at which the first and second lengthwise lines 242, 252 meet. In this embodiment, the second leading end 253 has the second oblique boundary 255. Steps (b) and (c) are simultaneously implemented for weaving both the first and second strap portions 24, 25.

In step (d), the first and second weft threads 63, 64 which are respectively guided by the first and second weft needles 65, 66 are inserted through sheds which are cooperatively formed by the superposed first and second layers of warp threads 61, 62 so as to weave the thong portion 23 along a direction from one of the first and second thong ends 231, 232 to the other one of the first and second thong ends 231, 232. In this embodiment, the thong portion 23 is woven along the direction from the first thong end 231 to the second thong end 232.

In step (e), the first weft thread 63 is inserted through sheds formed in the first layer of warp threads 61 by the first weft needle 65 so as to weave the first extension portion 21 from the first thong end 231 or the first trailing end 244 of the first strap portion 24 of a preceding one of the strap units 2. In this embodiment, the first extension portion 21 is woven from the first trailing end 244 of the first strap portion 24 of the preceding one of the strap units 2. (see FIG. 5).

In step (f), the second weft thread 64 is inserted through sheds formed in the second layer of warp threads 62 by the second weft needle 66 so as to weave the second extension portion 22 from the first thong end 231 or the second trailing end 254 of the second strap portion 25 of a preceding one of the strap units 2. In this embodiment, the second extension portion 22 is woven from the second trailing end 254 of the second strap portion 25 of the preceding one of the strap units 2 (see FIG. 5).

The plurality of the strap units 2 can be successively and efficiently produced using the needle loom 6, and the patterns and the shapes of the strip unit 2 can be varied according to design requirement. For example, as shown in FIG. 3, each of the first and second strap portions 24, 25 may have an increased width section/segment that gradually increases in width away from the second thong end 232, and an equal-width section/segment extending from increased width section/segment toward the respective distal end 241 (251).

In this embodiment, each of the warp threads 61, 62 and the first and second weft threads 63, 64 is selected from a terylene yarn (which may be a high-tension yarn or a low-tension yarn), a nylon yarn (which may be a high-tension yarn or a low-tension yarn), a metallic yarn, etc.

Figure 7:
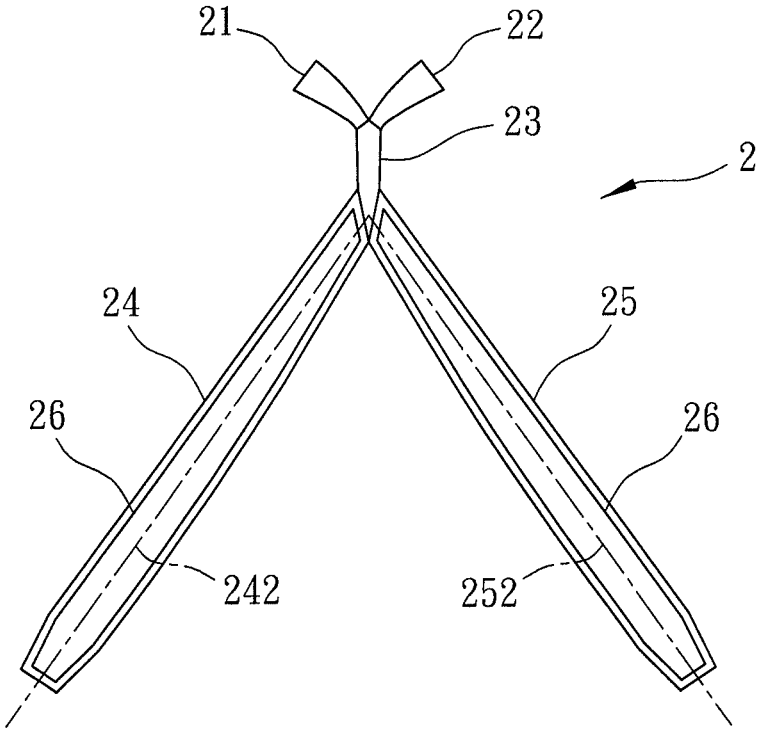
FIG. 7 is a schematic view of a strap unit used in a second preferred embodiment of a flip-flop according to this invention.

FIG. 7 shows a strap unit 2 used in a second preferred embodiment of a flip-flop according to this invention. In this embodiment, the strap unit 2 further includes two reinforcing pieces 26 disposed on the first and second strap portions 24, 25, respectively, and extending along the first and second lengthwise lines 242, 252, respectively. With the provision of the reinforcing pieces 26, the structure of the first and second strap portions 24, 25 can be enhanced.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A flip-flop comprising:

a sole for a wearer's foot to rest thereon, said sole having upper and lower surfaces, said upper surface including front, middle and rear regions; and a strap unit including a thong portion which has a first thong end secured to said front region, and a second thong end opposite to said first thong end, and first and second strap portions extending rearwardly from said second thong end to terminate at and be secured to left and right sides of said middle region, respectively, said strap unit being made by the steps of:

(a) providing superposed first and second layers of warp threads;

(b) inserting a first weft thread through sheds formed in said first layer of warp threads so as to weave said first strap portion along a first lengthwise line such that one of first leading and trailing ends of said first strap portion has a first oblique boundary which is at an oblique angle to the first lengthwise line;

(c) inserting a second weft thread through sheds formed in said second layer of warp threads so as to weave said second strap portion along a second lengthwise line such that one of second leading and trailing ends of said second strap portion has a second oblique boundary which is at an oblique angle to the second lengthwise line, and which joins said first oblique boundary to cooperatively define said second thong end at which the first and second lengthwise lines meet; and (d) inserting said first and second weft threads through sheds which are cooperatively formed by said superposed first and second layers of warp threads so as to weave said thong portion along a direction from one of said first and second thong ends to the other one of said first and second thong ends.

2. The flip-flop of claim 1, wherein said strap unit further includes first and second extension portions which extend downwardly from said first thong end through said sole to be secured to said lower surface of said sole, said first and second extension portions being made by the steps of:

(e) inserting said first weft thread through sheds formed in said first layer of warp threads so as to weave said first extension portion; and (f) inserting said second weft thread through sheds formed in said second layer of warp threads so as to weave said second extension portion.

3. The flip-flop of claim 1, wherein each of said first and second strap portions extends from said second thong end and through the sole to terminate at a distal end which is secured to said lower surface of said sole.

4. The flip-flop of claim 1, wherein said first and second lengthwise lines cooperatively define an included angle that ranges between 30° and 90°.

5. The flip-flop of claim 1, further comprising two reinforcing pieces disposed on said first and second strap portions, respectively, and extending along the first and second lengthwise lines, respectively.

6. The flip-flop of claim 1, wherein steps (b) and (c) are simultaneously implemented by a double weft needles method.

7. The flip-flop of claim 1, wherein each of said warp threads and said first and second weft threads is selected from the group consisting of a terylene yarn, a nylon yarn, and a metallic yarn.

* * * * *